US005884422A

United States Patent [19]

Marshall et al.

[11] Patent Number: 5,884,422

[45] **Date of Patent: *Mar. 23, 1999**

[54] INDICATOR AND GARMENT HANGER

[75] Inventors: David John Marshall, Victoria; Joseph Charles Hollis, East Bentleigh, both of Australia

[73] Assignee: Spotless Plastics Pty. Ltd., Australia

[ * ] Notice: The term of this patent shall not extend beyond the expiration date of Pat. No. 5,388,354.

[21] Appl. No.: 782,537

[22] Filed: Jan. 10, 1997

Related U.S. Application Data

[63] Continuation-in-part of Ser. No. 173,905, Dec. 27, 1993, Pat. No. 5,507,086, and a continuation of Ser. No. 382,842, Feb. 3, 1995, Pat. No. 5,628,132, which is a continuation-in-part of Ser. No. 176,087, Dec. 30, 1993, Pat. No. 5,388,354, which is a continuation of Ser. No. 985,342, Nov. 30, 1992, abandoned, which is a continuation of Ser. No. 741,462, Sep. 17, 1991, abandoned, said Ser. No. 173,905, is a division of Ser. No. 670,963, May 2, 1991, Pat. No. 5,272,806, which is a continuation-in-part of Ser. No. 287,985, Dec. 20, 1988, abandoned.

[51] Int. Cl.[6] ..... G09F 3/00

[52] U.S. Cl. ..... 40/322

[58] Field of Search ..... 40/322, 299; 223/85

[56] References Cited

U.S. PATENT DOCUMENTS

| | | |
|---|---|---|
| D. 192,845 | 5/1962 | Cohen . |
| D. 236,572 | 9/1975 | Ostroll et al. . |
| D. 244,197 | 5/1977 | Ostroll . |
| D. 264,912 | 6/1982 | Bliss et al. . |
| D. 282,982 | 3/1986 | Kodet . |
| D. 302,214 | 7/1989 | Wilson . |
| 1,634,377 | 7/1927 | Montan et al. . |
| 2,074,841 | 3/1937 | Haimowitz . |
| 2,099,596 | 11/1937 | Bruening . |
| 2,288,071 | 6/1942 | Cohen . |
| 3,024,953 | 3/1962 | O'Keefe . |
| 3,341,031 | 9/1967 | Myers . |
| 3,457,693 | 7/1969 | Jackson . |
| 3,535,808 | 10/1970 | Morrish . |
| 3,545,069 | 12/1970 | Krieger . |
| 3,734,268 | 5/1973 | Burger et al. . |
| 3,949,914 | 4/1976 | Ostroll . |
| 3,955,491 | 5/1976 | McMahon . |
| 4,006,547 | 2/1977 | Samuels et al. . |
| 4,006,812 | 2/1977 | Everett et al. . |
| 4,030,528 | 6/1977 | Horning . |
| 4,045,899 | 9/1977 | Richardson . |
| 4,115,940 | 9/1978 | Phillips . |
| 4,137,661 | 2/1979 | Johansson . |
| 4,172,513 | 10/1979 | Bradstreet et al. . |
| 4,322,902 | 4/1982 | Lenthall . |
| 4,333,590 | 6/1982 | Princiotta . |
| 4,335,987 | 6/1982 | Laxo . |
| 4,450,639 | 5/1984 | Duester . |
| 4,714,156 | 12/1987 | Kolton et al. . |
| 4,830,172 | 5/1989 | Hilton et al. . |
| 4,863,078 | 9/1989 | Bengsch . |
| 4,886,195 | 12/1989 | Blanchard . |
| 4,967,500 | 11/1990 | Bredeweg . |
| 4,997,114 | 3/1991 | Petrou . |
| 5,065,852 | 11/1991 | Marti . |
| 5,096,101 | 3/1992 | Norman et al. . |
| 5,377,884 | 1/1995 | Zuckerman . |

FOREIGN PATENT DOCUMENTS

| | | |
|---|---|---|
| A 42318/78 | 6/1979 | Australia . |
| B1-42 320 | 6/1979 | Australia . |
| B1-55988/80 | 6/1980 | Australia . |
| A1-57011/80 | 9/1980 | Australia . |
| A 13313/83 | 11/1983 | Australia . |
| A 32008/84 | 2/1985 | Australia . |
| B 26077/84 | 8/1986 | Australia . |
| A 2 010 774 | 7/1979 | Germany . |
| 3401816 | 7/1985 | Germany . |
| 975548 | 8/1980 | Russian Federation . |
| 518708 | 8/1972 | Sweden . |
| WO90/09651 | 8/1990 | WIPO . |

*Primary Examiner*—Milton Nelson, Jr.
*Attorney, Agent, or Firm*—Scully, Scott Murphy & Presser

[57] ABSTRACT

A plastic garment hanger having a hook with an abutment for engaging an aperture formed in an indicator cap to support the indicator cap on the hanger is provided. A hook having an upwardly projecting web which defines an aperture wherein a descending flexible tongue for engaging an aperture formed in an indicator cap is also provided.

16 Claims, 3 Drawing Sheets

INDICATOR AND GARMENT HANGER

CROSS-REFERENCE TO RELATED APPLICATIONS

This is continuation of U.S. Ser. No. 08/382,842 filed Feb. 3, 1995, now U.S. Pat. No. 5,628,132, which is a continuation-in-part of U.S. Ser. No. 08/176,087 filed Dec. 30, 1993, now U.S. Pat. No. 5,388,354, which is a file wrapper continuation of U.S. Ser. No. 07/985,342 filed Nov. 30, 1992, now abandoned, which is a file wrapper continuation of U.S. Ser. No. 07/741,462, filed on Sep. 17, 1991, now abandoned, corresponding to International Application No. PCT/AU90/00048 having an international filing date of Feb. 8, 1990.

This is also a continuation-in-part of U.S. Ser. No. 08/173,905 filed Dec. 27, 1993, now U.S. Pat. No. 5,507,086, which is a divisional of U.S. Ser. No. 07/670,963, filed May 2, 1991, now U.S. Pat. No. 5,272,806, which is a continuation-in-part of U.S. Ser. No. 07/287,985 filed Dec. 20, 1988, now abandoned.

FIELD OF THE INVENTION

This invention relates to indicators for garment hangers of the type which may be used to indicate the size of a garment supported by the hanger and/or the name of the manufacturer or retailer. This invention is also directed to the field of garment hangers to which indicators are attached and from which clothing or other articles of apparel are suspended.

BACKGROUND OF THE INVENTION

For purposes of displaying garments suspended on hangers in an orderly and attractive manner to the retail customer, it is often desired to affix an indicating means on the hanger in a position visible to the retail customer while the hanger is suspended on a rack. The indicating means identifies some attribute of the garment suspended from the hanger, such as size, quality, color, manufacturing data, or pattern.

To accommodate the various types of hangers available in the industry numerous indicating means have been developed in a variety of shapes, sizes and materials. Similarly, hangers have been developed to accommodate a variety of different indicating means.

For example, in U.S. Pat. No. 4,137,661 to Johansson a carrier attached to the bottom of a hook of a garment hanger is disclosed. A label may be adhered to or inserted in the carrier portion.

U.S. Pat. No. 3,024,953 to O'Keefe discloses a rectangular plastic guard which is adapted to be secured to the wire hook of a clothes hanger, and which extends upwardly therefrom to assist in preventing the clothes hangers from becoming entangled with one another.

U.S. Pat. No. 1,099,261 to Lewyt discloses a clothes hanger particularly adapted for hanging sets of furs, with a metal rectangular plate 10 which receives an index card describing the furs suspended therefrom and is positioned substantially between the hook and body portion of the hanger.

U.S. Pat. No. 4,115,940 to Phillips discloses an indicia-bearing tab which attaches to a member located substantially at the junction of both the hook and the body member.

U.S. Pat. No. Des. 302,214 to Wilson includes two embodiments directed to ornamental designs for garment hangers which include a designated member for attaching an indicating means.

U.S. Pat. No. Des. 244,197 to Ostroll discloses an ornamental design for a size indicator that is intended for attachment to a garment hanger.

The provision of a readily visible size indicator on a garment hanger is now accepted by retailers as a desirable addition to a garment hanger. The most widely accepted indicators have been manufactured by the applicant under Australian Patent No. 509042 (AU-B-42320/78 which corresponds to U.S. Pat. No. 4,322,902 to Lenthall) and Australian Patent No. 522614 (AU-B-55988/80). While the indicator disclosed in Australian Patent No. 509042 in particular has been well received by retailers in Australia, the desire of some retailers to reduce to a minimum the costs of hangers and indicators has meant that other manufacturers have developed less aesthetically pleasing alternatives to the indicator of the Australian Patent. In addition, differences in attitude have indicated that the "cap" indicator of Australian Patent No. 509042 may be regarded by some as being too bulky and dominant in the overall view of the hanger and the garments supported thereon. Furthermore, since the hook of the hanger must be specially formed to accept this indicator, its use without the indicator may be regarded by some as aesthetically or commercially unacceptable.

SUMMARY OF THE INVENTION

One object of the present invention is to provide a less costly and less obtrusive alternative to the cap indicator described in Patent No. 509042.

The invention therefore provides an indicator suitable for attachment to the hook of a molded plastic garment hanger, said indicator comprising a body adapted to display indicia, and comprising side walls and end walls dimensioned to form a body having a low generally rectangular profile and defining a downwardly opening cavity shaped and dimensioned to receive a narrow upwardly projecting web formed on a hook of a molded plastic garment hanger, said body having regions between at least said side walls and a top which are smoothly rounded while the lowermost edges of at least said side walls are substantially non-rounded to define relatively sharp edges at said lowermost edges, said end walls being spaced to engage in use spaced points on said web such that said indicator is in use stably supported on said web, said smoothly rounded portions and said sharp edges facilitating sorting of said indicators into a preferred orientation.

In a preferred form, the cavity is formed with a centrally positioned means dimensioned and positioned to receive an abutment means formed on the upwardly projecting web of the hook of the hanger. In one form, at least one side of the body of the indicator defining the cavity is formed with an opening adapted to receive said abutment. In a particularly preferred form, each side of the body has an opening adapted to receive an abutment formed on either side of the web of the hanger hook.

The invention also provides in combination, an indicator suitable for attachment to the hook of a molded plastic garment hanger, said indicator comprising a body adapted to display indicia and comprising side walls, end walls and a top wall dimensioned to form a body having a low generally rectangular profile and defining a downwardly opening cavity shaped and dimensioned to receive a narrow upwardly projecting web formed on a hook of a molded plastic garment hanger, said body having regions between at least said side walls and said top wall which are smoothly rounded while the lowermost edges of at least said side walls are substantially non-rounded to define relatively sharp edges at said lowermost edges, said end walls being spaced to engage in use spaced points on said web such that said indicator is in use stably supported on said web, said smoothly rounded portions and said sharp edges facilitating sorting of said indicators into a preferred orientation.

Another object of the present invention is to provide a garment hanger having a means capable of receiving and engaging a corresponding means on an indicating means. More particularly, the present invention also includes a garment hanger having an indexing cap for identifying at least one characteristic of the garment hanging therefrom wherein the garment hanger includes a hook adapted to engage a rod or other supporting means, and an upstanding flange extending from the hook for receiving one indexing cap, said flange extending and projecting above the top contour of the hook. The hanger of the present invention also includes a snap-fit engagement means defined by the upstanding flange, and a generally planar and stackable indexing cap having a recess formed therein for receiving the flange of the hanger therewithin. The indexing cap also defines a through opening which facilitates stacking the indexing cap in a bundle of stacked caps during transport, and which receives the snap fit engagement means when the indexing cap is attached to the hanger.

BRIEF DESCRIPTION OF THE DRAWINGS

The foregoing and other objects of the invention may now be more readily ascertained from the following detailed description of preferred embodiments thereof, taken in conjunction with the accompanying drawings; in which:

FIG. 7 illustrates a cross-section of the index coded cap taken along line 3—3 of FIG. 6;

FIG. 8 represents a corresponding cross-section of a second embodiment of the hanger taken along section line 3—3' of FIG. 6;

DESCRIPTION OF THE PREFERRED EMBODIMENTS

Figure 1:
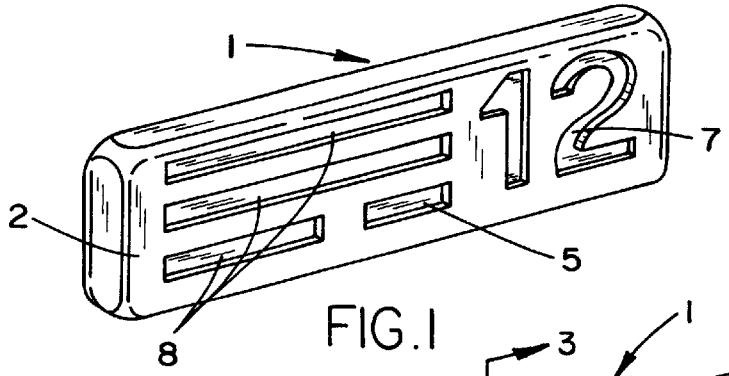
FIG. 1 is a perspective view of an indicator embodying the invention.
Figure 2:
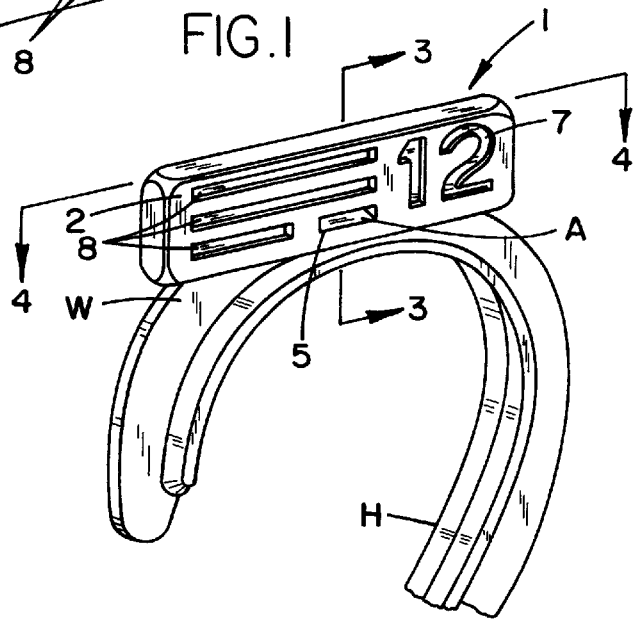
FIG. 2 is a perspective view of the indicator of FIG. 1 fitted to the hook of a hanger.
Figure 3:
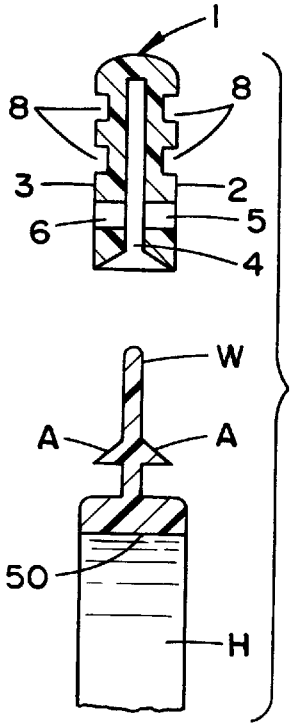
FIG. 3 is a sectional end elevation view of the indicator taken along line 3—3 in FIG. 2 and a first embodiment of the hook as illustrated in FIG. 2 but with the hook removed from the indicator.
Figure 4:
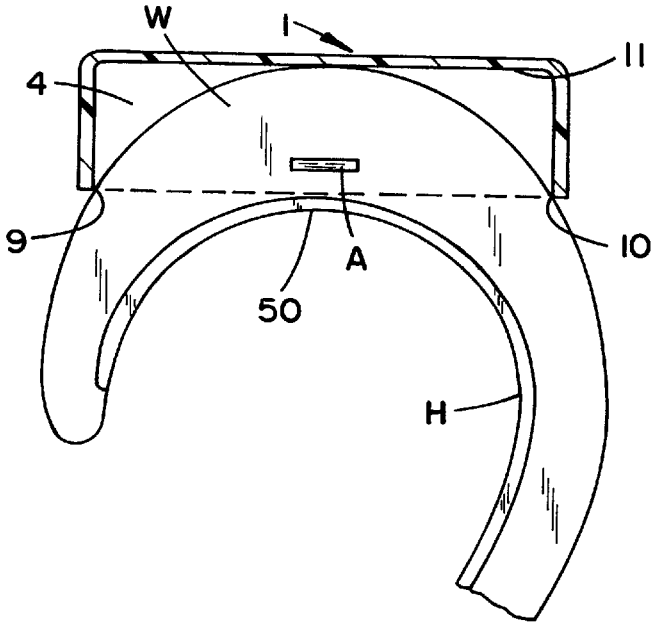
FIG. 4 is an enlarged transverse sectional view of FIG. 2 taken along line 4—4'.

Referring to the drawings, and particularly FIGS. 1–4, the indicator embodying the invention will be seen to comprise a body 1 molded from suitable plastic material having spaced flat sides 2 and 3 defining therebetween a cavity 4 dimensioned to receive a top web W of the hook H of a garment hangers, as shown in FIGS. 3 and 4 of the drawings. The sides 2 and 3 are formed with generally rectangular slots 5 and 6 recessed therein centrally located adjacent the lower edges of the sides 2 and 3, and which are dimensioned and positioned to receive abutments A formed on either side of the web W of the hook H of the hanger to lock the indicator in position on the hook H. The lowermost horizontal surfaces of slot 5 and 6 each form a retaining shelf which engages the abutment. The entry of abutments A into slots 5 and 6 is achieved by the resilience of the plastic molding forming the body 1.

The indicator of the embodiment depicted in FIGS. 1–4 includes a substantially hollow body having at least four sides and an open bottom, a generally parallel pair of opposed sides and a generally parallel pair of opposed ends connecting the sides. Each of the sides and ends includes an inner surface and outer surface.

Each side 2 and 3 of the indicator 1 is formed with indicia 7, in the present embodiment, a sizing number such as 12. In the present case, the indicia 7 is formed by molded depressions in the sides 2 and 3, although the indicia may equally well be formed by molded raised portions or by adhesive label applied to the sides 2 and 3. If desired, styling grooves such as 8 may also be formed in or on the surface of the sides 2 and 3.

It will be appreciated from FIGS. 2 and 4 of the drawings that the width of the indicator body 1 is approximately the same as the width of the hook H of the hanger, and the indicator has a relatively low narrow rectangular profile, both of which features contribute to the indicator being less obtrusive than indicators of the type described in Australian Patent No. 509042. Of course, shapes other than rectangular may be adopted, but it is considered desirable that the width of the indicator should not materially exceed the width of the hook of the hanger so that the indicator is less obtrusive in use.

The indicator body may also be formed with smoothly rounded edges, particularly at the upper most edges of the body, as shown in FIG. 3. This feature allows the indicators to be sorted with the cavity directed downwardly by running the indicators along a narrow edge in the sorting machine (not shown) whereby the engagement between the rounded edges and the narrow edge cause an indicator engaging the edge in this manner to topple over so that its cavity is directed downwardly.

The web W formed on the hook of the hanger H is shaped to provide engagement points between the ends 9 and 10 of the opening to the cavity 4 and the top 11 of the cavity 4 when the indicator is fitted to the web W to limit movement of the indicator on the hook H. By the same token, the shape of the web W is not significantly different from a "normal" shape so the hanger can be used with or without the indicator.

While the web shape shown in FIG. 4 is preferred, for stability, a more standard web shape will provide acceptable results since the ends 9 and 10 of the opening to the cavity 4 of the indicator will still engage spaced edge portions of the web W to limit the amount of movement of the indicator even though the top of the web W does not contact the top 11 of the cavity 4. In either event, the web is significantly less obtrusive than the modified hook shape required in the case of the indicator of Australian Patent No. 509042.

Of course, the web may be molded with an upwardly projecting generally rectangular portion (not shown) which substantially fills the cavity 4 to inhibit any significant movement of the indicator on the web W of the hook H.

Such an arrangement has the advantage of providing a rectangular surface on the hook for labels when the indicator is not used.

Alternatively, the cavity 4 may be shaped to correspond to the shape of the web W, although the net benefit of such an arrangement would not appear to outweigh the extra amount of plastic required for such a molding.

It will be appreciated from the above description that the indicator embodying the invention provides an aesthetically acceptable alternative to the indicator disclosed in Australian Patent No. 509042 with only a minimal modification being required to the shape of the hook of the hanger to which the indicator is to be applied. The indicator presents a narrow profile which does not excessively modify the shape of the uppermost end of the hook of the hanger, while the hook itself may be used without the indicator since it is not significantly different in shape to other hooks.

The indicators embodying the invention also lend themselves to automated application techniques which are assisted by the rounded upper edges of the indicator, as described in greater detail above.

FIGS. 5–10 illustrate a second embodiment of the garment hanger and the index coded cap of the present invention. While the invention will be described and illustrated with respect to a single bra and panty hanger, it is understood that the invention is equally applicable to other types of garment hangers.

Figure 5:
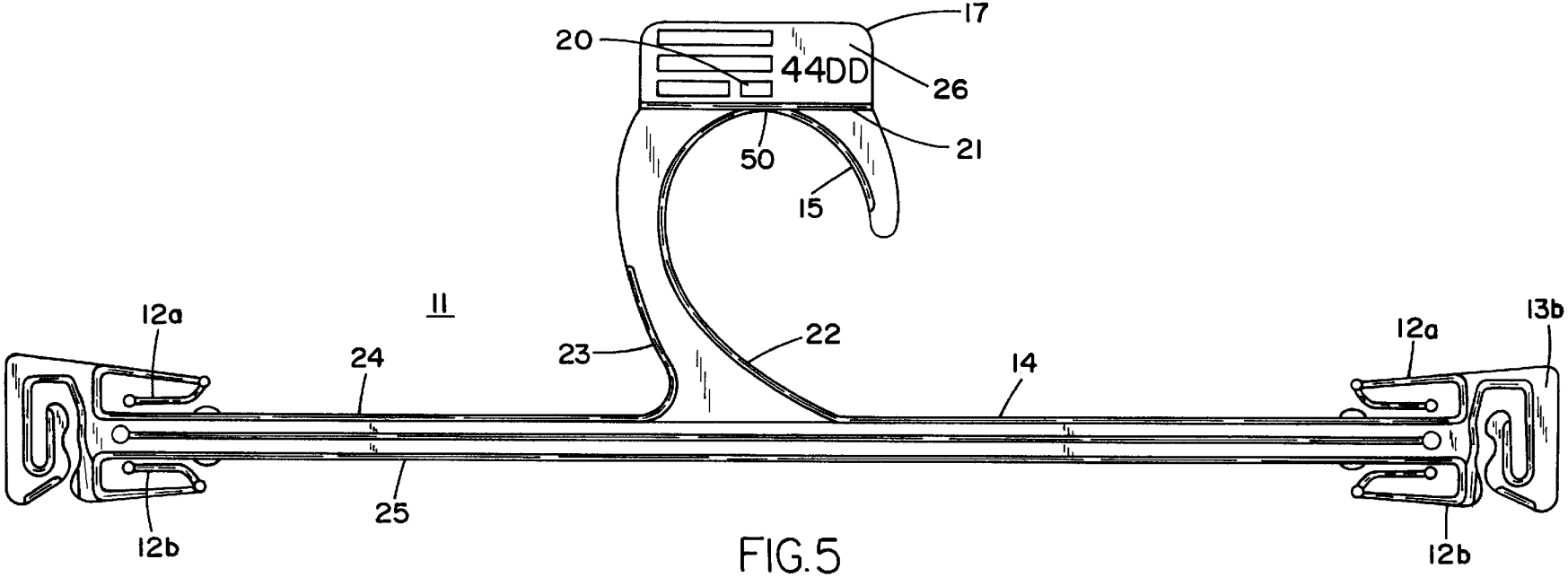
FIG. 5 is a plan view of one side of a bra and panty garment hanger having an index coded cap relating to an attribute of a bra to be suspended therefrom.
Figure 6:
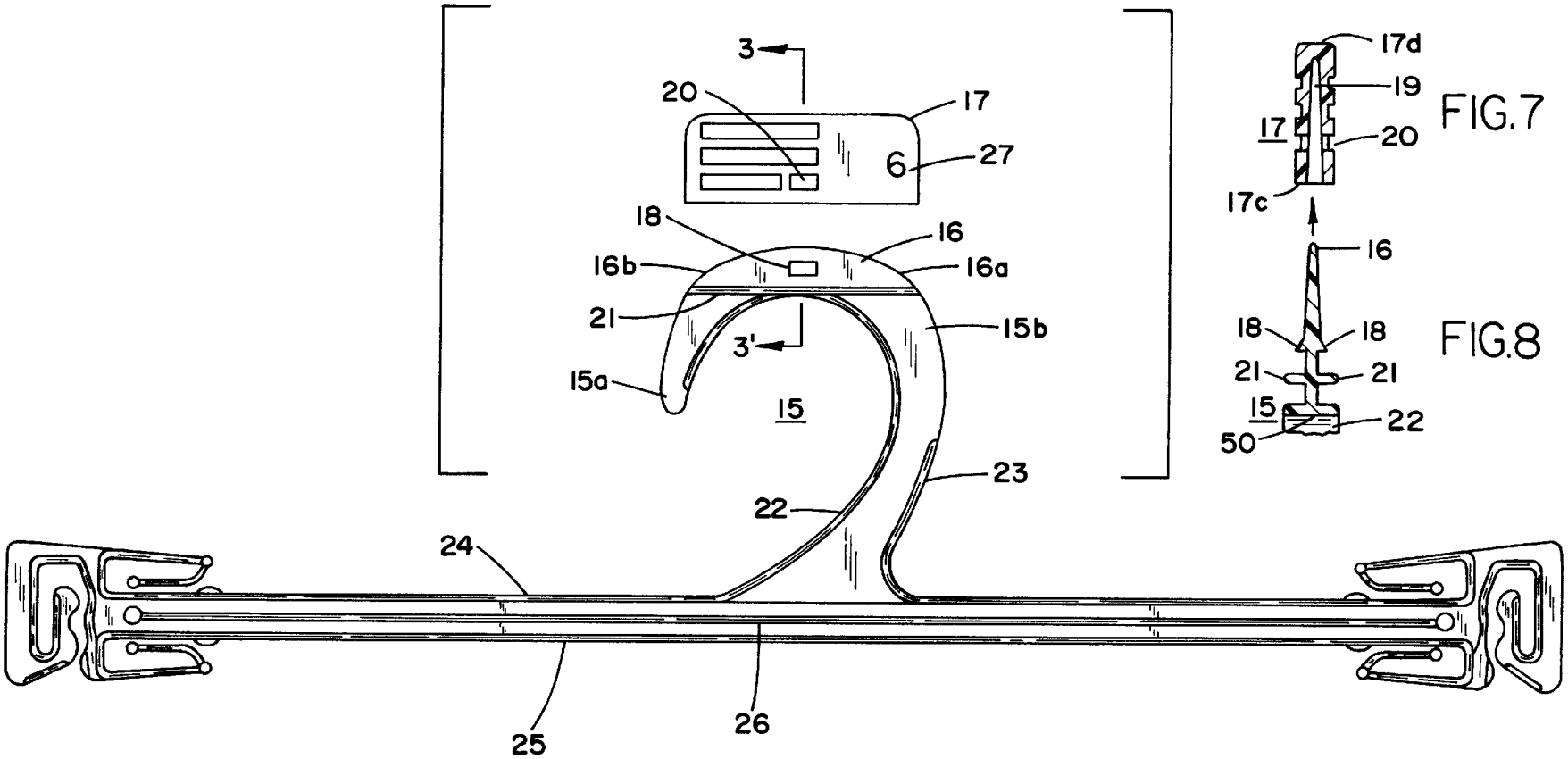
FIG. 6 is an exploded view of the opposite side of the bra and panty hanger illustrated in FIG. 5 with the index coded cap separated from the hanger and displaying an attribute of a panty to be suspended therefrom.

As illustrated in FIGS. 5 and 6, the garment hanger is a bra and panty hanger having bra hanger strap clips 12*a*, 12*b* and panty hanger clips 13*a*, 13*b* arranged at either end of central support 14. The hanger presents a first side in FIG. 5 and the opposite side in FIG. 6 with the indexing cap positioned for attachment in FIG. 6.

The hanger also includes a hook member 15 having an upstanding flange 16 (illustrated in FIG. 6) for receiving one of a plurality of different indexing caps, one of which is illustrated at 17 in FIGS. 5–10. The flange 16 projects above the top contour 50 of hook 15. A snap fit engagement means 18 is defined on the upstanding flange 16 as illustrated in FIG. 6. The index coded cap 17 is generally planar and stackable and has a recess 19 formed therein (illustrated in FIG. 7) for receiving the upstanding flange 16 therewithin. The indexing cap 17 defines a through opening 20 (illustrated in FIGS. 5–7) which receives the snap fit engagement means 18 when the indexing cap is fitted to the upstanding flange. This through opening is also used to form a bundle of stacked caps. The hook member further defines a horizontal flange 21 which cooperates with the snap fit engagement means 18 and a first edge 16*a* and a second edge 16*b* of flange 16 to engage the recess 19 defined within index cap in a wedging manner. Edges 16*a* and 16*b* extend upwardly and inwardly in an angular fashion (as illustrated in FIG. 8) to assist in centering the cap for engagement of the snap fit engagement means 18. Hook member 15 also includes an inner flange 22 which extends from the tip 15*a* of the hook to the intermediate frame member 14 to strengthen the hook and to provide a larger load bearing surface when the hanger engages a rod or other supporting means during use. Hook member 15 also includes a second reinforcing rib 23 which extends upwardly from control support member 14 to strengthen the hook and to resist twisting or flexure of the hook 15 when the garment hanger is in use. Flanges 22, 23 join with similarly defined upper flange 24, defined by central support member 14. Central support member 14 includes upper and lower flanges 24, 25 and a center medial flange 26 which serve to stiffen the hanger.

By choosing a relatively resilient plastic material for the hanger 11, and a relatively stiff plastic material for the cap, the snap fit engagement can be made relatively permanent, since once the index coded cap is secured snap fit engagement barbs (or bosses) 18, it is necessary to bend or flex the side walls 17*a*, 17*b* beyond barbs 18 before the cap can be removed. The stiffness of the plastic material used to form the cap thereby determines the degree of difficulty one encounters in removing the cap. Further, the fit and cooperation of the flat edge 17*c* of the cap and the horizontal flange 21 make it difficult to insert a screw driver, or other means, with which to pry the side walls apart for removal of the cap.

As illustrated in FIGS. 5–10, the indexing cap includes several indexing features. The cap is color coded to denote a specific attribute of the garment suspended from the hanger. In addition, the indexing cap 17 carries on one side the legend 44 DD as illustrated at 26 to denote a bra size suspended from the hanger. On the opposite side of the cap, as illustrated at 27 in FIG. 6, a panty size "6" is indicated for a hypothetical bra and panty set. In this instance, the color coding can relate to a certain grade and quality of garment, a certain style of garment, or to visually reinforce one of the printed indicia such as cup size or panty size. This color attribute assists the purchaser in selecting the appropriate garment for his or her intended use.

The indexing cap 17 is planar, having first and second planar sides 17*a*, 17*b* which facilitate stacking of the caps for shipment as a bundle of stacked caps. The bottom portion of the cap 17*c* defines a flat edge, while the top edge 17*d* of the cap is rounded. The flat configuration 17*c* and rounded configuration 17*d* assist the sorting and stacking mechanism in a machine (not shown) which automatically aligns and stacks caps in a predetermined manner.

Figure 10:
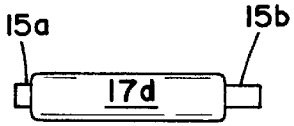
FIG. 10 illustrates a top view of the indexing cap and hook illustrated in FIG. 5.
Figure 9:
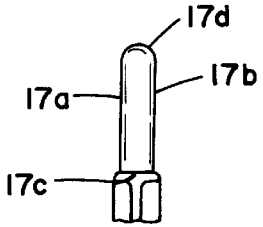
FIG. 9 illustrates an end view of the indexing cap seated on the hanger hook as illustrated in FIG. 5.

As illustrated in FIG. 10, the top of the indexing cap 17*d* is unadorned in the preferred embodiment and is somewhat wider than the internal flange 15*a* and 15*b*. It should be noted that as illustrated in FIG. 10, flanges 22 and 23 are not visible, and that horizontal flange 21 is substantially the same length as the indexing cap 17, and therefore not visible in FIG. 10.

The garment hanger illustrated in FIGS. 5 and 6 also includes a center strengthening rib 26. The use of ribs 22–26 allow the central web of the hanger to be reduced in thickness and weight, thereby reducing the material cost for the hanger and the shipping cost during transit from the various remote manufacturing facilities to the United States.

In the preferred embodiment, the hanger of the present invention is formed of styrene which provides a clear, virtually transparent hanger for maximum display of garments suspended therefrom. Alternately, the hanger could be formed from K resin, H. I. styrene and polypropylene or other suitable thermoplastics.

While there have been shown and described what are considered to be the preferred embodiments of the invention, it will, of course, be understood that various modifications and changes in form or detail can readily be made without departing from the spirit of the invention. It is therefore intended that the invention not be limited to the exact form and detail herein shown and described nor to anything less than the whole of the invention herein disclosed as hereinafter claimed.

What is claimed is:

1. In combination, a hanger for garments and other articles and an indicator securable to said hanger for indicating information associated with the garment or article;

said hanger defining a hook for engaging a structure, said hook including a support for receiving said indicator and also including means for engaging said indicator; and said indicator being receivable on said support, said indicator including a substantially hollow body having at least four sides and defining an open bottom, a generally parallel pair of opposed sides and a generally parallel pair of opposed ends connecting said sides, each of said sides having a generally planar outer side surface for displaying the information and inner side surfaces, at least one of said inner side surfaces including means for interlocking with said engaging means of said hanger hook to secure said indicator to said hook when said indicator is received on said support and each of said sides being configured and dimensioned to resiliently bow outwardly such that said indicator is engageable with or disengageable from said support by causing at least one of said sides to bow outwardly relative to said support.

2. The combination hanger and indicator as recited in claim 1, wherein said engagement means defines at least one boss projecting outwardly from at least one opposed side of said hook, and said means for interlocking with said engagement means comprises a flat surface projecting outwardly from said inner side surface of said indicator.

3. The combination hanger and indicator as recited in claim 1, wherein said inner side surfaces of said indicator each define at least one recess, where said recess on each of said inner side surfaces is disposed opposite each other along the length of the indicator.

4. The combination hanger and indicator recited in claim 1, wherein each of said planar outer side surfaces includes indicia bearing information.

5. The combination hanger and indicator as recited in claim 4, wherein said information is unitarily molded into said side surfaces and said end surfaces.

6. The combination hanger and indicator as recited in claim 4, wherein said information is printed onto said side surfaces.

7. A combination hanger for garments and other articles, and an indicator securable to said hanger for indicating information associated with the articles;

said hanger defining a hook for engaging a structure, said hook including a support for receiving said indicator and also including means for engaging said indicator, said means for engaging defining at least one boss projecting outwardly from at least one opposed side of said hook; and said indicator being receivable on said support, said indicator including a substantially hollow body having at least four sides and defining an open bottom, a generally parallel pair of opposed sides, and a generally parallel pair of opposed ends connecting said sides, each of said sides having a generally planar outer side surface and inner side surfaces, at least one of said inner side surfaces defining at least one elongated opening including means for interlocking with said engaging means of said hanger hook to secure said indicator to said hook when said indicator is received on said support, said means for interlocking comprising a retaining shelf associated with said opening and each of said sides being configured and dimensioned to resiliently bow outwardly such that said indicator is engageable with or disengageable from said support by causing at least one of said sides to bow outwardly relative to said support.

8. The combination hanger and indicator as recited in claim 7, wherein said inner side surfaces include first and second openings which are disposed opposite each other along a length of the indicator.

9. The combination hanger and indicator as recited in claim 7, wherein each of said planar outer side surfaces include indicia bearing information.

10. A combination hanger for garments and other articles, and an indicator securable to said hanger for indicating information associated with the articles;

said hanger defining a hook for engaging a structure, said hook including a support for receiving said indicator and also including means for engaging said indicator, said means defining at least one boss projecting outwardly from at least one opposed side of said support; and said indicator being receivable on said support, said indicator including a hollow body having at least four sides and defining an open bottom, a generally parallel pair of opposed sides and a generally parallel pair of opposed ends connecting said sides, each of said sides having a generally planar outer side surface and an inner side surface, said inner side surfaces respectively defining at least one opening including means for interlocking with said engaging means of said hanger hook to secure said indicator to said hook when said indicator is received on said support, where said openings defined in said inner side surfaces are disposed opposite to each other and each of said sides being configured and dimensioned to resiliently bow outwardly such that said indicator is engageable with or disengageable from said support by causing at least one of said sides to bow outwardly relative to said support.

11. A combination hanger for garments and other articles, and an indicator securable to said hanger for indicating information associated with the articles;

said indicator including a substantially hollow body having at least four sides and defining an open bottom, a generally parallel pair of opposed sides and a generally parallel pair of opposed ends connecting said sides, each of said sides having a generally planar outer side surface and an inner side surface at least one of said inner side surfaces defining means for engaging said hanger; and said hanger defining a hook for engaging a structure, said hook including a support for receiving said indicator and also including means for retaining said indicator, said retaining means interlocking with said engaging means of said indicator to secure said indicator to said hook when said indicator is received on said support and each of said sides of said indicator being configured and dimensioned to resiliently bow outwardly such that said indicator is engageable with or disengageable from said support by causing at least one of said sides to bow outwardly relative to said support.

12. The combination hanger and indicator as recited in claim 11, wherein said retaining means of said hanger are longitudinally disposed on opposite sides of said hook in opposing relation along the length of said hook, and correspond to said engaging means of said indicator.

13. The combination hanger and indicator as recited in claim 11, wherein said retaining means of said hanger comprises at least one projection defined by said hook and includes means for interlocking with said engaging means of said indicator.

14. The combination hanger and indicator as recited in claim 13, wherein said means for interlocking comprises a shelf associated with said opening defined in said hook.

15. In combination, a hanger for garments and other articles, and an indicator securable to said hanger for indicating information associated with the garment or article;

said hanger defining a hook for engaging a structure, said hook including a support for receiving said indicator and also including a first engagement means for engaging said indicator; and said indicator being receivable on said support, said indicator including a body having at least four sides and defining a generally parallel pair of opposed sides and a generally parallel pair of opposed ends connecting said sides, each of said sides having a generally planar outer side surface for displaying the information and a second engagement means which cooperates with said first engagement means to secure said indicator to said hook when said indicator is received on said support, and one of said first or second engagement means being configured and dimensioned to resiliently bow outwardly such that said indicator is engageable with or disengageable from said support by causing at least one of said means to bow outwardly relative to said indicator to interlock said indicator to said support.

16. In combination, a hanger for garments and other articles, and an indicator securable to said hanger for indicating information associated with the garment or other article;

said hanger defining a hook having a top contour for engaging a structure, said hook including a support for mounting said indicator, said support on said hook including first and second indicator engagement means for engaging said indicator, said indicator being receivable on said support above said top contour, said indicator including a generally parallel pair of opposed sides, each of said sides having a generally planar outer side surface for displaying said information;

said indicator including first and second engagement areas recessed within said indicator for cooperating with said first and second indicator engagement means to secure said indicator to said support;

said first and second indicator engagement areas and said first and second indicator engagement means being resiliently deformable to bow outwardly and enable a snap fit engagement of said indicator on said support, said indicator being readily visible when said hanger is in use by virtue of its position on said hook.

* * * * *

UNITED STATES PATENT AND TRADEMARK OFFICE

CERTIFICATE OF CORRECTION

PATENT NO. : 5,884,422
DATED : March 23, 1999
INVENTOR(S) : D. J. Marshall et al.

It is certified that error appears in the above-identified patent and that said Letters Patent is hereby corrected as shown below:

Title page,
Item [56], References Cited, FOREIGN PATENT DOCUMENTS, "Germany" should read -- Great Britain --

Column 3,
Line 51, "line 3-3" should read -- line 3-3' --

Column 8,
Line 67, "hook" should read -- indicator --

Signed and Sealed this

Eleventh Day of March, 2003

JAMES E. ROGAN
*Director of the United States Patent and Trademark Office*